US008685233B2

(12) United States Patent
Subramaniyam

(10) Patent No.: US 8,685,233 B2
(45) **Date of Patent: *Apr. 1, 2014**

(54) METHOD OF REMOVAL OF CALCIUM FROM HYDROCARBON FEEDSTOCK

(75) Inventor: Mahesh Subramaniyam, Thane West (IN)

(73) Assignee: Dork Ketal Chemicals (I) Private Limited, Mumbai (IN)

( * ) Notice: Subject to any disclaimer, the term of this patent is extended or adjusted under 35 U.S.C. 154(b) by 632 days.

This patent is subject to a terminal disclaimer.

(21) Appl. No.: 12/376,962

(22) PCT Filed: Aug. 21, 2007

(86) PCT No.: PCT/IN2007/000360

§ 371 (c)(1),
(2), (4) Date: Aug. 4, 2009

(87) PCT Pub. No.: WO2008/062433

PCT Pub. Date: May 29, 2008

(65) Prior Publication Data

US 2010/0163457 A1 Jul. 1, 2010

(30) Foreign Application Priority Data

Aug. 22, 2006 (IN) ..... 1317/MUM/2006

(51) Int. Cl.
*C10G 17/04* (2006.01)

(52) U.S. Cl.
USPC ..... 208/252; 208/265; 208/282

(58) Field of Classification Search
USPC ..... 208/252, 265, 282
See application file for complete search history.

(56) References Cited

U.S. PATENT DOCUMENTS

| | | | | |
|---|---|---|---|---|
| 4,629,807 | A | 12/1986 | Knifton | |
| 4,789,463 | A | 12/1988 | Reynolds | |
| 4,795,824 | A | 1/1989 | Kippax et al. | |
| 4,853,109 | A | 8/1989 | Reynolds | |
| 5,078,858 | A | 1/1992 | Hart et al. | |
| 6,274,542 | B1 | 8/2001 | Carr et al. | |
| 6,713,649 | B1 | 3/2004 | Hladiy et al. | |
| 6,936,727 | B2 | 8/2005 | Sutton et al. | |
| 7,399,403 | B2 | 7/2008 | Garcia, III et al. | |
| 7,455,763 | B2 * | 11/2008 | Luo et al. | 208/251 R |
| 2004/0045875 | A1 * | 3/2004 | Nguyen et al. | 208/251 R |
| 2005/0241997 | A1 | 11/2005 | Kremer et al. | |
| 2013/0193374 | A1 | 8/2013 | Subramaniyam | |

FOREIGN PATENT DOCUMENTS

| | | | |
|---|---|---|---|
| CN | 1202208 | * | 5/2005 |
| EP | 2074196 | A2 | 7/2009 |
| WO | 2005085392 | A1 | 9/2005 |
| WO | 2007086661 | A1 | 8/2007 |
| WO | 2008007847 | A1 | 1/2008 |
| WO | 2008062433 | A2 | 5/2008 |
| WO | 2008062433 | A3 | 5/2008 |
| WO | 2009113095 | A2 | 9/2009 |
| WO | 2009113095 | A3 | 9/2009 |

OTHER PUBLICATIONS

Dean, John A., "Lange's Handbook of Chemistry," Fifteenth Edition, 1999, Cover and 5 pages, McGraw Hill, Inc.

Foreign communication from the priority application—International Search Report and Written Opinion of the International Searching Authority, PCT/IN2007/00360, Oct. 31, 2008, 6 pages.

Foreign communication from the priority application—International Preliminary Report on Patentability, PCT/IN2007/000360, Feb. 24, 2009, 5 pages.

Foreign communication from a related counterpart application—International Search Report and Written Opinion, PCT/IN2009/000062 dated Oct. 5, 2009, 12 pages.

Foreign communication from a related counterpart application—International Preliminary Report on Patentability, PCT/IN2009/000062 dated Jul. 27, 2010, 9 pages.

Office Action dated Jul. 9, 2013 (11 pages), U.S. Appl. No. 13/804,288, filed Mar. 14, 2013.

* cited by examiner

*Primary Examiner* — Renee E Robinson

(74) *Attorney, Agent, or Firm* — Conley Rose, P.C.; Rodney B. Carroll

(57) ABSTRACT

The invention relates to field of processing hydrocarbon feedstock including crude oil, wherein metals such as calcium are removed. In the face of the rising prices of crude oil, refiners are forced to process opportunity crudes such as DOBA, which pose many problems including fouling of equipment due to certain metallic salts, such as calcium napthenate. Calcium, which cannot be removed from crude oil during normal desalting process, poses very serious problems. The invention provides method for removal of calcium, wherein crude oil is mixed, with effective metal removing amount of aqueous extraction solution of an additive comprising a chemical compound selected from a group consisting of metallic acid, maleic anhydride or fumaric acid or salts or derivatives thereof, enabling separation of hydrocarboneous phase and aqueous phase containing metal ions, in crude desalter. Only hydrocarboneous phase devoid of calcium is processed further, thereby preventing fouling of equipment.

12 Claims, 3 Drawing Sheets

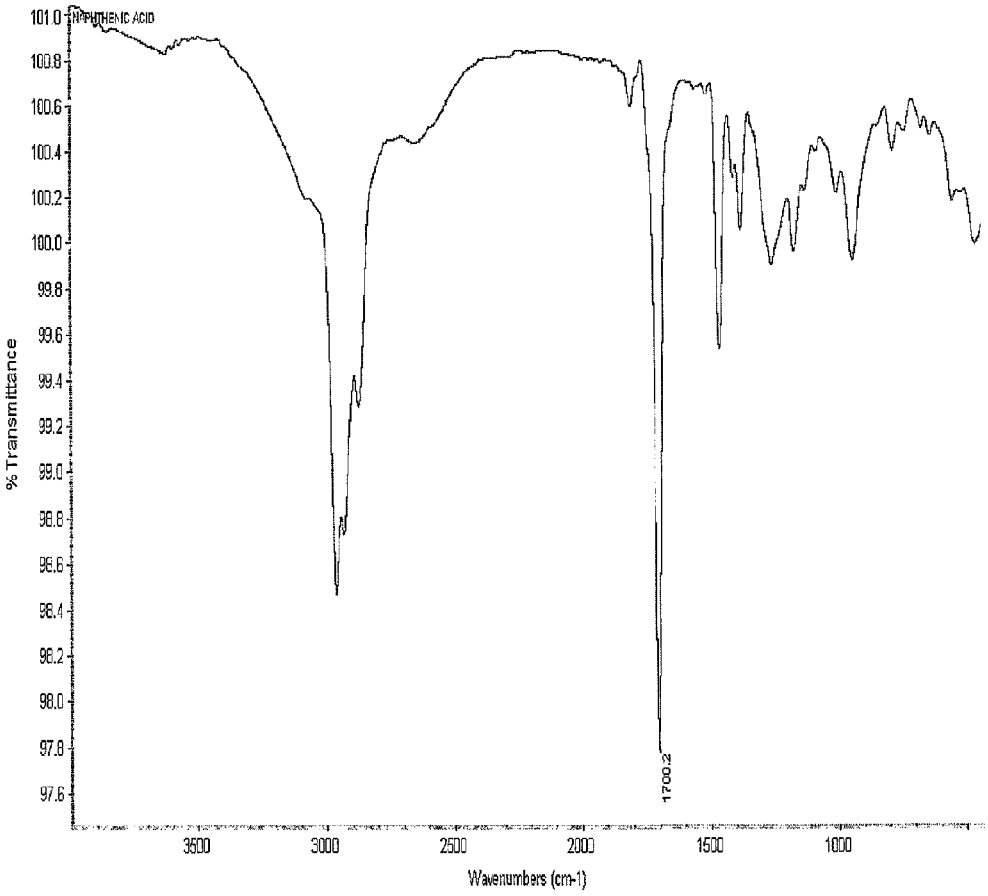
Fig.1: *FTIR spectrum of naphthenic acid*

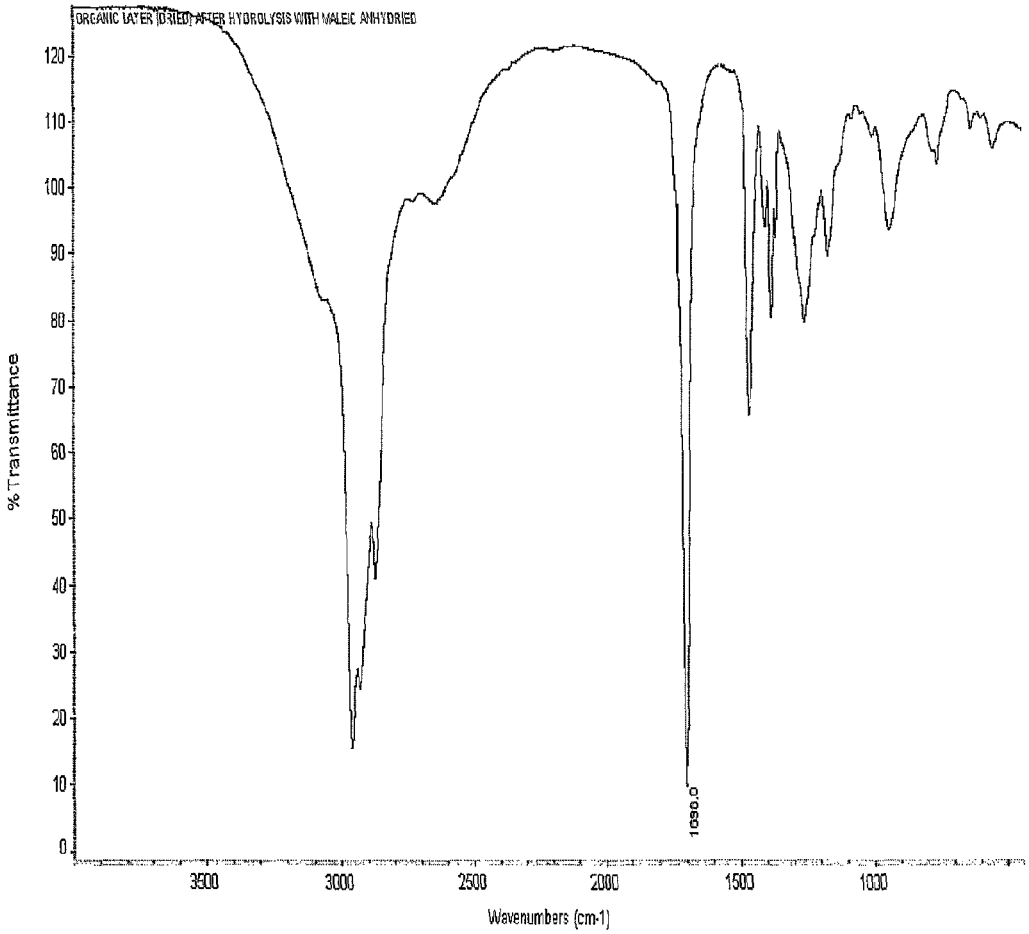
Fig.2: *FTIR spectrum of Organic layer (oven dried) after reaction*

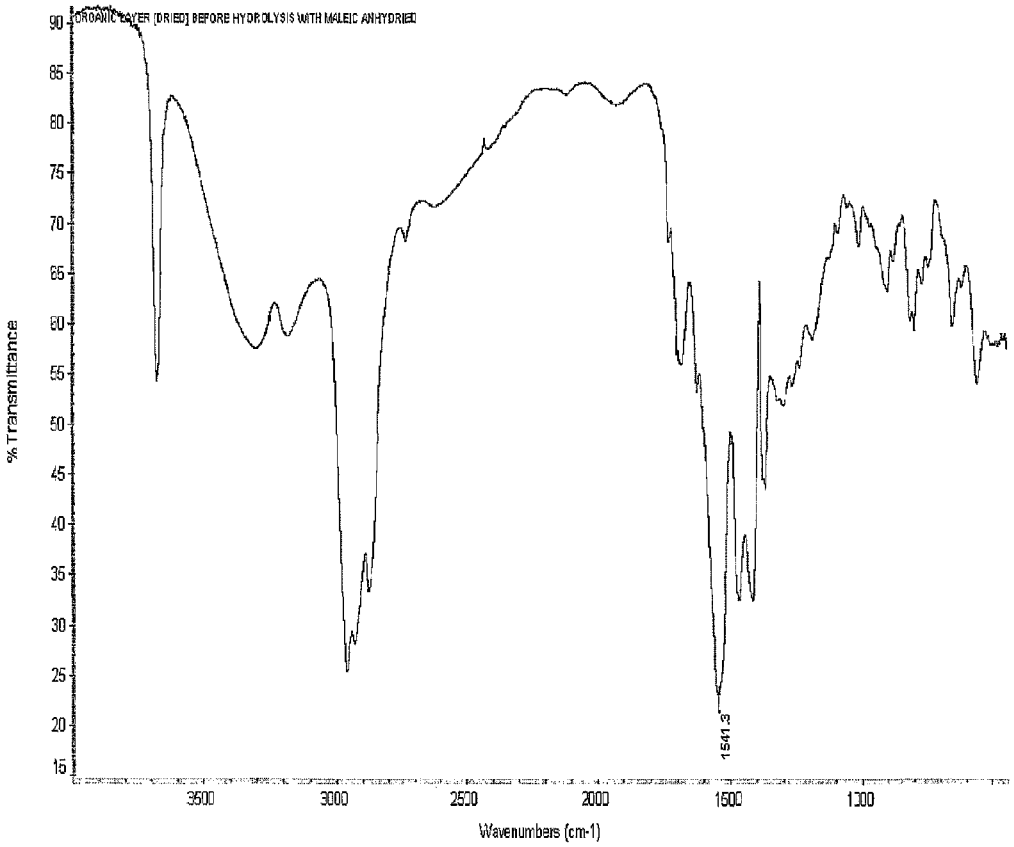
Fig.3: *FTIR spectrum of Organic layer [Ca-naphthenate in toluene (oven dried)] before reaction*

METHOD OF REMOVAL OF CALCIUM FROM HYDROCARBON FEEDSTOCK

CROSS-REFERENCE TO RELATED APPLICATIONS

This application is a filing under 35 U.S.C. 371 of International Application No. PCT/IN2007/000360 filed Aug. 21, 2007, entitled "Method of Removal of Calcium from Hydrocarbon Feedstock," claiming priority of Indian Patent Application No. 1317/MUM/2006 filed Aug. 22, 2006, which applications are incorporated by reference herein in their entirety.

FIELD OF INVENTION

The present invention is generally related to the field of hydrocarbon industry and particularly related to removal of metals from hydrocarbon feedstock and more particularly to removal of calcium from the same.

BACKGROUND OF INVENTION

Considering the rising prices of crude oil, the refiners are forced to process opportunity crude such as DOBA, to be competitive. However these opportunity crudes pose many problems such as fouling of heat exchangers, difficulties in effluent treatment, poisoning of catalyst by certain metallic salts and such other problems.

Among the metals, calcium poses very serious problems which cannot be tackled using the current refinery processes. Calcium exists in crude oil as calcium complex of naphthenic acid, which hereinafter is referred to as calcium naphthenate. The calcium naphthenate is not removed from the crude oil during the normal desalting process. The examples of the type of crude oil which contains large amounts of calcium naphthenate are crudes from China such as Shengli No. 2; DOBA from West Africa; Gryphon and Harding crude oil from the North Sea; and SJV from the West Coast of USA.

In an oil refinery, the desalting of crude oil has been practiced for many years. The crude is usually contaminated from several sources, including, metals including calcium, zinc, silicon, nickel, sodium, potassium, and such other metals.

Desalting is necessary prior to further processing to remove these compounds and other inorganic materials that would otherwise cause fouling and deposits in downstream heat exchanger equipment and/or form corrosive salts detrimental to crude oil processing equipment. Further, these metals can act as poisons for the catalysts used in downstream refinery units. Effective crude oil desalting can help minimize the effects of these contaminants on the crude unit and downstream operations. Proper desalter operations provide the following benefits to the refiner:

(a) Reduced crude unit corrosion.

(b) Reduced crude preheat system fouling.

(c) Reduced potential for distillation column damage.

(d) Reduced energy costs.

(e) Reduced downstream process and product contamination.

Desalting is the resolution of the natural emulsion of water that accompanies the crude oil by creating another emulsion in which about 5 percent relative wash water is dispersed into the oil using a mix valve. The emulsion mix is directed into a desalter vessel containing a parallel series of electrically charged plates. Under this arrangement, the oil and water emulsion is exposed to the applied electrical field. An induced dipole is formed on each water droplet within the emulsion that causes electrostatic attraction and coalescence of the water droplets into larger and larger droplets. Eventually, the emulsion resolves into two separate phases—the oil phase (top layer) and the water phase (bottom layer). The streams of desalted crude oil and effluent water are separately discharged from the desalter.

The entire desalting process is a continuous flow procedure as opposed to a batch process. Normally, chemical additives are injected before the mix valve to help resolve the oil/water emulsion in addition to the use of electrostatic coalescence. These additives effectively allow small water droplets to more easily coalesce by lowering the oil/water interfacial tension.

Crude oil that contains a high percent of particulate solids can complicate the desalting process. The particulate solids, by nature, would prefer to transfer to the water phase. However, much of the solids in a crude oil from a field exists in tight water-in-oil emulsions. That is, oil-wetted solids in high concentration in the crude may help form tight oil and water emulsions that are difficult to resolve. These tight emulsions are often referred to as "rag" and may exist as a layer between the separated oil and water phases. The rag layer inside the desalter vessel may grow to such an extent that some of it will be inadvertently discharged with the water phase. This is a problem for the waste water treatment plant since the rag layer still contains a high percentage of unresolved emulsified oil.

Much of the solids encountered during crude oil desalting consists commonly as particulates such as iron oxide, iron sulfide, sand, clay and even phosphorus-containing compounds, etc. Other metals that are desirably removed include, but are not necessarily limited to, calcium, zinc, silicon, nickel, sodium, potassium, and the like, and typically a number of these metals are present. Some of the materials may be present in a soluble form, and some may require modification through reaction such as reaction or neutralization to become soluble. The metals may be present in inorganic or organic forms. In addition to complicating the desalter operation, phosphorus and other contaminants are of particular concern to further downstream processing. This includes the coking operation since iron and other metals remaining in the processed hydrocarbon yields a lower grade of coke. Removing the metals from the crude oil early in the hydrocarbon processing stages is desired to eventually yield high quality coke as well as to limit corrosion and fouling processing problems.

Several treatment approaches have been made to reduce total contaminant levels and these all center on the removal of contaminants at the desalter unit. Normally, the desalter only removes water soluble inorganic salts such as sodium or potassium chlorides.

Basic metals such as calcium, when present in crude oil can lead to fouling of heaters and heat exchangers and poison catalysts used in crude processing. When present as inorganic salts, such as, chlorides, usually in an oil encapsulated water phase, the salts can hydrolyze to release corrosive mineral acids. Refinery desalters customarily remove such salts. However, oil-soluble metal salts such as naphthenates and phenolates are not removed by conventional desalting. Therefore, oil-soluble, basic metal-rich crudes are less valuable than crudes with low levels of such metals. A process for metal ion removal enables the increase of the value of such crudes.

A few, but increasingly important, petroleum crude feedstocks, residua, and deasphalted oil derived from them, contain levels of calcium or iron which render them difficult, if not impossible, to process using conventional refining techniques. The metals contaminants causing particular problems are in the form of nonporphyrin, organometallically bound compounds. These species have been attributed to either naturally occurring calcium complexes or solubilized calcium from recovery waters that comes in contact with crude oils.

One possible class of calcium compounds identified in particular is the respective naphthenates and their homologous series. These organometallic compounds are not separated from the feedstock by normal desalting processes, and in a conventional refining technique they can cause the very rapid deactivation of hydroprocessing catalysts. Examples of feedstocks demonstrating objectionably high levels of calcium compounds are crudes from China such as Shengli No. 2; DOBA from West Africa; Gryphon and Harding crude oil from the North Sea; and SJV from the West Coast of USA.

U.S. Patent Application 0050241996 describes the use of only poly(acrylic acid) derivatives, (that is, polymers) for removing metal irons from hydrocarbon feedstocks. Even though this patent has listed 16 representative non-ionic water soluble monomers, 27 representative anionic monomers and 30 cationic monomers, wherein list of anionic monomers include maleic acid and fumaric acid, there is absolutely no suggestion or teaching in this patent, that any of these monomers can be used independently or in combination for removing metal ions from the hydrocarbon feedstocks. There is insistence in this patent on use of aqueous solution of only one or more water-soluble poly (acrylic acid) derivatives, that is use of polymers for the purpose of this US patent application.

It is known to a person skilled in the art that, it is necessary that a catalyst is used to react with a monomer of an acid to form its derivatives in a polymeric from. This adds to the cost of the process due to time involved and equipments and chemicals used in the process and such other factors.

In addition, it is observed by the inventor of present invention that when poly (acrylic acid) derivative of US Patent Application 0050241996 is used, (that is, ACUMER-1000 is used), heavy precipitation takes place, which can lead to fouling of the processing equipments. This is clear from the data provided in Table 6, Experiment No. 1 of the present specification. Also to prevent this precipitation higher dosages of the additive are required. The higher dosage will lead to higher cost. Other disadvantage of using additives having a tendency to precipitate is that it will be difficult to control the dosage at the desired level in the equipments in the field, such as crude desalter, and hence additive will have to be used always in excess.

The inventor of the present invention, after extensive experimentation, has surprisingly found that the use of aqueous solution of any of the anionic monomers such as maleic acid, maleic anhydride and fumaric acid, efficiently remove metal ions like calcium from calcium naphthenate contained in the hydrocarbon feedstock such as crude oil with negligible precipitate or, without giving any precipitate. Refer to Table 4, Experiments 1 to 3.

This clearly brings out that the distinguishing features of the present invention as compared to features of US patent application Ser. No. 0050241996, which features are as given below.

The present invention uses aqueous solution of only any of anionic monomers such maleic acid, maleic anhydride or fumaric acid, for removing metal ions like calcium from calcium naphthenate, contained in the hydrocarbon feedstock like crude oil. There is no precipitation observed after use of any of these additives compounds, used by the present inventor. It does not use polymers like poly (acrylic acid) derivatives for this purpose. Refer to Table 4, Experiments 1 to 3.

US Patent Application 2005/0241997 A1 describes different additives useful for enhancing phosphorous compound removal in refinery desalting process. Reactive phosphorus species can be removed or transferred from a hydrocarbon phase to a water phase in an emulsion breaking process by using a composition that contains water-soluble hydroxy acids. Suitable water-soluble hydroxy acids include, but are not necessarily limited to glycolic acid, gluconic acid, C.sub.2-C.sub.4 alpha-hydroxy acids, poly hydroxy carboxylic acids, thioglycolic acid, chloro acetic acid, polymeric forms of the above hydroxyacids, poly-glycolic esters, glycolate ethers, and ammonium salt and alkali metal salts of these hydroxyacids, and mixtures thereof. The composition may optionally include a mineral acid to reduce the pH of the desalter wash water. A solvent may be optionally included in the composition. This US patent application permits transfer of reactive phosphorus species into the aqueous phase with little or no hydrocarbon phase undercarry into the aqueous phase. The composition is particularly useful in treating crude oil emulsions, and in removing calcium and other metals therefrom.

This US Patent Application 2005/0241997 A1, teaches the use of only hydroxyl mono-carboxylic acids such as, glycolic acid and polyhydroxy derivative thereof, like gluconic acid as an additive compound for removal of reactive phosphorous species, and calcium and other metals, from the hydrocarbon feedstock. However, the disadvantage of the use of these acids and derivatives as additives compound, as seen from the experiments conducted by the present inventor to remove calcium from calcium napthenate from hydrocarbon feedstock, is that these acids require higher dosages as additive compound since they are to be used in 2:1 molar ration with respect to calcium. When gluconic acid was used as additive compound by the present inventor, in the same molar ratio, that is, 2:1, very high dosage of gluconic acid is required.

There is no teaching or suggestion in this US patent application 2005/0241997 for using maleic acid, maleic anhydride or fumaric acid as additive compound for removing calcium from the hydrocarbon feedstock including crude oil. The present invention categorically suggests the use of maleic acid, maleic anhydride or fumaric acid as additive compound for removal of calcium from calcium naphthenate contained in crude oil. This is the distinguishing feature between the present invention and this U.S. patent application.

In view of above, there is a need for developing a new method for the effective removal of metal contaminants, particularly calcium, from hydrocarbon feedstocks, including crude oil.

SUMMARY OF THE INVENTION

Accordingly, different objects and advantages of the present invention are described below.

An object of the present invention is to provide an economical method with increased efficiency due to lesser dosage of the chemical compounds used.

Another object of the present invention is to provide an efficient method to prevent precipitation of calcium salt in hydrocarbon phase or water phase.

Further object of the present invention is to provide an effluent of higher pH value, thereby giving a non-corrosive effluent.

Still further objects and advantages of the present invention will become apparent from the ensuing detailed description of the invention.

BRIEF DESCRIPTION OF THE DRAWINGS

A brief description of the accompanying drawings is given below:

FIG. 1 shows, FTIR spectrum of naphthenic acid.

FIG. 2 shows, FTIR spectrum of organic layer (oven dried) after reaction.

FIG. 3 shows, FTIR spectrum of organic layer [Ca-naphthenate in toluene (oven dried)] before reaction.

DETAILED DESCRIPTION OF THE INVENTION

In the method of the present invention, for removal of calcium from the hydrocarbon feedback, the following chemical compounds are used, which are Maleic Anhydride, Maleic Acid or Fumaric Acid and salts or derivatives of all of these. These salts and derivatives are used to effectively remove calcium from the hydrocarbon phase, particularly from the calcium napthenate present in the hydrocarbon.

The method the present invention comprises the steps of:

(a) mixing the aqueous solution of any one of the chemical compounds such as the Maleic anhydride, Maleic Acid or Fumaric Acid or their salts or derivates or homo polymers or appropriate combination thereof, with any hydrocarbon stream such as crude oil, containing metal and its salts, such as calcium naphthenate (b) permitting formation of two phases, that is, aqueous phase and the hydrocarboneous phase;

(c) separating the two phases of step (b) or permitting them to separate.

When the mixture is formed as per the step (a) above, the metal ions are readily bound or chelated to carboxylic acid groups of the present invention such as maleic acid, fumaric acid, or maleic anhydride or their salts or derivatives or homo polymers thereof to form a complex. This metal-acid complex is ionic and water soluble.

These two phases, that is, the aqueous phase and the crude or hydrocarboneous phase, are separated or permitted to separate. As a result, the aqueous solution containing the metal contaminant is removed, thereby resulting in a hydrocarbon feed with metals already removed from it, which then can be handled in the same manner as any other carboneous feed and processed by conventional hydroprocessing techniques.

It is contemplated that the physical separation process is ordinarily to be done in a conventional crude desalter, which is usually used for desalting petroleum crudes before they are hydroprocessed. This separation is to be done by any separation process, however, and also includes countercurrent extraction.

The contact time between the aqueous extraction solution and the hydrocarboneous feed during mixing action is important and varies from between less than few seconds to about six hours. The preferred contact time is from about 5 seconds to about 2 hours.

Preferably, the chemical compounds mentioned in step (a) above, are injected into the desalter wash water prior to blending of this wash water with the incoming crude oil. This mixture is then passed through a high shear valve to obtain through contact of the water with the crude oil. This process is called "desalting" and is literally removing water soluble chloride salts from the oil. The chloride salts are present due to the water found in the incoming crude oil. Essentially, the salt concentration is diluted by the addition of the wash water. The wash water is treated with dimulsifiers to help the oil/water separation. Any water remaining with oil effluent from the desalter will have low salt values. Temperatures in the desalter typically range from about 93° C. to about 163° C.

To remove metals such as calcium in the desalter, the chemical compounds mentioned in step (a) above are added continuously to the wash water. With the vigorous mixing of the oil and water, this chemical compound chelates the calcium. This complex formed with the calcium is water soluble, hence the calcium is removed via the water phase.

The dosage of each of the above mentioned chemical compounds and the combinations thereof, generally ranges from about 0.001 to 5 weight percent in the desalter wash water. The present invention can be used in molar, submolar or excess molar concentrations with respect to metals in the hydrocarbon stream such as calcium or its salts such as calcium napthenate.

When the inventor of the present invention performed experiments using succinic acid, a type of dicarboxylic acid, as an additive compound, for removing calcium from calcium naphthenate contained in the hydrocarbon feedstock, including crude oil, it was observed that the reaction leads to substantial amount of precipitate which indicates that it can cause fouling in the desalter unit and also in other units used in processing of hydrocarbon feedstock, including crude oil. Refer to Table 3 Experiment No. 1.

When the inventor of the present invention performed experiments using malic acid, a type of hydroxyl dicarboxylic acid, as an additive compound, for removing calcium from calcium naphthenate contained in the hydrocarbon feedstock, including crude oil, it was observed that the reaction leads to substantial amount of precipitate which indicates that it can cause fouling in the desalter unit and also in other units used in processing of hydrocarbon feedstock, including crude oil. Refer to Table 3 Experiment No. 2.

When the inventor of the present invention performed experiments using tartaric acid, a type of polyhydroxy dicarboxylic acid, as an additive compound, for removing calcium from calcium naphthenate contained in the hydrocarbon feedstock, including crude oil, it was observed that the reaction leads to substantial amount of precipitate deposits which indicates that it can cause fouling in the desalter unit and also in other units used in processing of hydrocarbon feedstock, including crude oil. Refer to Table 3 Experiment No. 3.

When the inventor of the present invention performed experiments using citric acid, which is a monohydroxy tricarboxylic acid, as an additive compound, for removing calcium from calcium napthenate contained in the hydrocarbon feedstock, including crude oil, it was observed that the reaction leads to substantial amount of precipitate which indicates that it can cause fouling in the desalter unit and also in other units used in processing of hydrocarbon feedstock, including crude oil. Refer to Table 5 Experiment No. 1.

When the inventor of the present invention performed experiments using polymeric form of maleic acid, that is polymaleic acid, (PM-200), as an additive compound, for removing calcium from calcium napthenate contained in the hydrocarbon feedstock, including crude oil, it was observed that the reaction leads to substantial amount of precipitate deposits which indicates that it can cause fouling in the desalter unit and also in other units used in processing of hydrocarbon feedstock, including crude oil. Refer to Table 6 Experiment No. 3.

However it is clearly brought out by the present inventor, after extensive experimentation, that use of any of maleic acid, maleic anhydride or fumeric acid, as an additive compound for removing calcium from calcium naphthenate contained in the hydrocarbon feedstock, including crude oil, does not lead to precipitation or in some experiments lead to negligible amount of precipitation. Hence this prevents any fouling of equipment. Refer to Table 4 Experiments 1 to 3.

The foregoing may be better understood by reference to the following examples, which are presented for the purposes of illustration and are not intended to limit the scope of the invention.

General points about the examples 1 to 4:

1. The details of the quantities of Calcium-naphthenate in toluene having an amount of calcium of 2247 ppm in the hydrocarbon layer and demineralised water, used in each of the experiments given below, are given in Table-1.
2. The Calcium naphthenate was prepared by reaction of sodium salt of napthenic acid (2 moles) and calcium chloride (1 mole). The product was washed to remove sodium chloride. The napthenic acid used had an acid value of approximately 226 mg koh/gm. The resulting calcium naphthenate had approximately 7.5% of calcium. This was dissolved in toluene to get an approximately 2247 ppm of calcium. The FTIR spectras of Naphthenic Acid, and Calcium Naphthenate are shown in the FIGS. 1 and 3 respectively.

3. FTIR spectrum figures are given only for Example 1. For other examples, only the observational results are specified in Tables 2 to 8.
4. The weight of the calcium salt of the additive compound is weighted, where relevant, and is given in Tables 2 to 8.
5. It is observed that some of the additive compounds, after reaction with calcium naphthenate, form their own calcium salts which precipitate. These precipitates are weighed and entered in Tables 2 to 8.
6. The mole ratio of calcium to additive compound is also given in Tables 2 to 8. For example, calcium acetate contains 2 moles of acetic acid and 1 mole of calcium. This is theoretically possible mole ratio. Apart from this, actual weight of additive compound is also mentioned in Tables 2 to 8. If the additive is in solution form, the weight of active ingredient is given in Tables 2 to 8.
7. Generally, results given in Tables 2 to 8, for each additive compound represents average of three experiments.
8. Results presented in Tables 2 to 6 are obtained after 2 hours of time for reaction at 98 to 105 degree centigrade. In cases of Tables 3, 5, and 6, where precipitates are formed, it is observed that the precipitates are insoluble, even after 2 hours of reaction conditions.
9. Results presented in Tables 7 to 8 are obtained after 15 minutes of reaction at 98 to 105 degree centigrade.
10. Generally the Calcium content in aqueous phase was measured using Ion Chromatographic technique (IC) and by Inductive coupled plasma for the hydrocarbon phase.

EXAMPLE 1

Procedure: Maleic anhydride, demineralized water and Ca-naphthenate in toluene were charged into a 250 ml round bottom flask, equipped with thermometer pocket and water condenser, and was refluxed for 2 hours. After 2 hours it was cooled to room temperature and the contents of the round bottom flask were poured into a separating funnel. Two separated layers that is top hydrocarboneous layer and bottom aqueous were collected and analyzed as mentioned below. The aqueous layer was analysed for pH, and Calcium content was analysed by using Ion Chromotography. The hydrocarboneous layer was dried to remove toluene and the dried sample was analysed by Fourier Transform Infrared Spectrometer (FTIR) as discussed below, and for Calcium content by using ICP technique (INDUCTIVE COUPLED PLASMA). The results are given in details below and in Table 4, Experiment No. 1.

In this example, the mole ratio of Ca-naphthenate to Maleic anhydride is 1:1, and the Calcium content of Ca-naphthenate solution in toluene used for this example is 2247 ppm.

Analysis:

FTIR Data:

FTIR spectrum of naturally occurring free naphthenic acid shown in FIG. 1 shows a characteristic peak at about 1700 $cm^{-1}$ due to the presence of carboxylic acid (COOH) group.

The FTIR spectrum of calcium napthenate shows a characteristic peak at about 1541 $cm^{-1}$ as shown in FIG. 3.

After completion of 2 hours of reaction of Ca-naphthenate solution in toluene with maleic anhydride it was observed, as shown in FIG. 2, that the toluene free hydrocarboneous layer showed the characteristic peak at about 1698 $cm^{-1}$ indicating the presence of free carboxylic acid group (similar to FIG. 1) such as free napthenic acid in the hydrocarboneous phase. The complete absence of 1541 $cm^{-1}$ peak of calcium napthenate in FIG. 2 indicates that the maleic anhydride is very effective in extracting into the water phase, the Calcium from calcium napthenate which was present in the hydrocarbon feed.

Ca Content Data:

The effectiveness of the present invention is further proved by measuring the Calcium content in aqueous layer after reaction which was found to be about 2200 ppm which was average of six readings indicating the efficiency of calcium removal greater than 95%. This is another evidence of high effectiveness of Maleic anhydride in causing complete removal of bound calcium in calcium napthenate which was present in the hydrocarbon feed. and extraction of this calcium into the water phase.

pH Values Data:

Before reaction, pH of the aqueous layer was about 2 due to presence of maleic acid in the aqueous phase and after reaction pH of the aqueous phase was found to be 6.41, there by indicating that conversion of free maleic acid into its calcium salt there by indicating effective extraction into the water phase of calcium from calcium napthenate. At this pH value the aqueous phase is non corrosive and this aqueous phase is clear and free of any precipitate at the bottom. This is the additional advantage of the present invention.

EXAMPLE 2

Experiment was conducted by repeating the procedural steps of EXAMPLE 1, but using the maleic acid, as additive compound. The result of the experiment is presented in Table 4, Experiment No. 2. The Calcium (ppm) in the aqueous phase measured [by Ion Chromatographic technique] is 2200. In FTIR (for dried sample) 1541 $cm^{-1}$ peak (for Calcium-naphthenate) was seen to be absent in the oil phase. The oil phase was further analysed for Calcium by ICP technique. Calcium was found to be less than 1 ppm.

The results show that calcium is effectively removed in soluble form, avoiding formation of precipitate, thereby preventing fouling of equipment.

EXAMPLE 3

Experiment was conducted by repeating the procedural steps of EXAMPLE-1, but using the fumaric acid, as additive compound. The result of the experiment is presented in Table 4, Experiment No. 3. The Calcium (ppm) [by IC technique] is 2100 ppm. In FTIR (for dried sample) 1541 $cm^{-1}$ peck (for Calcium naphthenate) was seen to be absent.

The results show the calcium is effectively removed in soluble form, avoiding formation of precipitate, thereby preventing fouling of equipment.

EXAMPLE 4

Separate experiments were conducted by repeating the procedural steps of EXAMPLE-1 but using each of the additive compounds listed below. The results are presented in Tables 2, 3, 5, and 6. After analyzing these results, it is seen that, from Table 2, Experiment 1 to 3, even though calcium is effectively removed, and the precipitate is absent, high dosages of acetic acid, glycolic acid, and gluconic acid are required. As seen from Table 3, Experiment 1 to 3, and Table 5, Experiment No. 1, even though, the calcium is effectively removed and the dosage is lower, precipitate is formed, which can lead to fouling of equipment. As seen from Table 6, Experiments 1 to 3, similar effects are observed.

List of additives compounds used in Example 4:

A) Mono-Carboxylic acid (Refer to Table 2):
  (i) Acetic acid (Experiment No. 1)
  (ii) Glycolic acid (Experiment No. 2)
  (iii) Gluconic acid (Experiment No. 3)

B) Saturated Di-Carboxylic acid (Refer to Table 3):
  (i) Succinic acid (Experiment No. 1)
  (ii) DL Malic acid (Experiment No. 2)
  (iii) L (+) Tartaric acid (Expeiement No. 3)

C) Tri-Carboxylic acid (Refer to Table 5)
  (i) Citric acid (Experiment No. 1)

D) Poly-Carboxylic acid (Refer to Table 6):
  (i) Acumer-1000 (Experiment No. 1). Acumer-1000 is a low molecular weight polyacrylate with a selected molecular weight around 2000.
  (ii) Acumer-2000 (Experiment No. 2). Acumer-2000 copolymer combines two functional groups: strong acid (sulfonate) and weak acid (carboxylate). The chemical compounds ACUMER 1000 and ACUMER 2000 were procured from ROHM AND HASS, 100, Independence Mall (West), Philadelphia, Pa. 19106-2399, USA.
  (iii) PM-200 (Experiment No. 3). PM-200 is a low molecular weight maleic homopolymer of molecular weight of approximately 600. PM-200—was procured from AQUAPHARM, 2A, Atur Chambers, Moledina Road, Pune 411 001, India.
  (iv) The calcium salts of all these three polymers under (D) have a tendency to precipitate and form deposits thereby fouling the equipment. To avoid this problem, higher dosages are used in practice, which leads to increased cost.

In cases of Tables 3, 5, and 6, where precipitates are formed, it is observed that the precipitates are insoluble, even after 2 hours of reaction conditions.

EXAMPLE 5

Details of a Field Test

A field test was conducted by using maleic anhydride as an additive compound for removal of calcium from hydrocarbon feedstock. The hydrocarbon feedstock used in this field test comprised 16% DOBA crude oil from Central Africa containing high amount of Calcium Naphthenate, and the rest 84% were blends of various crude oils. This field test was performed along with standard demulsifiers, and in a single stage crude desalter. Average dosage of maleic anhydride was 40 ppm with respect to calcium of hydrocarbon layer. The maleic anhydride was added to desalter wash water. The API of the crude oil was between 36 and 37. The temperature of desalter was in the range from 106° C. to 114° C. with operating pressure between 12 to 13 kg/cm$^2$. It was observed that, the input-feed to the crude desalter that is inlet feed contained 35 ppm of calcium and the desalter oulet contained 8 ppm of calcium, thereby indicating greater then 80% of efficiency in calcium removal, in the single stage desalter. The aqueous effluent of the crude desalter did not lead to any increase in B.O.D. (Biological Oxygen Demands) and C.O.D. (Chemical Oxygen Demands) in Waste Water Treatment Plant. Similarly, no scaling or corrosion problems were observed.

TABLE 1

Details of two Materials used in each experiment

| Sr. No. | Name of the raw materials used | Wt. (gm) | Wt. % |
|---|---|---|---|
| 1. | Calcium-naphthenate in toluene having an amount of calcium of 2247 ppm in the hydrocarbon layer | 50.0 | 49.862 |
| 2. | Demineralised water | 50.0 | 49.862 |

Ca-Naphthenate Reaction Data with Various Water Soluble Organic Acids.

I. Reaction Conditions: 50 gm Calcium-naphthenate in toluene having an amount of calcium of 2247 ppm in the hydrocarbon layer+50 gm DM water+Various Water Soluble Organic Acids (additive compounds) were refluxed at 98-105° C. temperature for 2 hrs.

TABLE 2

Saturated Mono Carboxylic Acid

| | | | | | Bottom Layer (Aqueous) | | | Top Layer (Organic) | |
|---|---|---|---|---|---|---|---|---|---|
| Exp. No. | Organic Acid | Type (Molecular wt.) | Mole Ratio (Acid:Ca) | Wt. of Acid (gm) 100% basis | Appearance | Conc. of Ca (by IC) [ppm] | Ca Removal Efficiency (%) | Conc. of Ca (by ICP) [ppm] | FTIR (dried sample) 1541 cm$^{-1}$ peak [for Ca-naphthenate] |
| 1. | Acetic Acid | (60) | 2:1 | 0.3375 | No ppt., Slight hazy | 2200 | 97.95 | <1 | Absent |
| 2. | Glycolic Acid | Hydroxy acetic acid (76) | 2:1 | 0.4256 | No ppt., Slight hazy | 2120 | 94.39 | 1 | Absent |
| 3. | Gluconic Acid | Polyhydroxy mono carboxylic acid (196) | 2:1 | 1.0976 | No ppt. | 2090 | 93.05 | 5 | Absent |

TABLE 3

Saturated Di-Carboxylic Acid

| Exp. No. | Organic Acid | Type (Molecular wt.) | Mole Ratio (Acid:Ca) | Wt. of Acid (gm) 100% basis | Bottom Layer (Aqueous) Appearance | Top Layer (Organic) FTIR (dried sample) 1541 cm$^{-1}$ peak [for Ca-naphthenate] |
|---|---|---|---|---|---|---|
| 1. | Succinic Acid | (118) | 1:1 | 0.3313 | White ppt. 0.1567 gm | Absent |

TABLE 3-continued

| Saturated Di-Carboxylic Acid | | | | | | |
|---|---|---|---|---|---|---|
| Exp. No. | Organic Acid | Type (Molecular wt.) | Mole Ratio (Acid:Ca) | Wt. of Acid (gm) 100% basis | Bottom Layer (Aqueous) Appearance | Top Layer (Organic) FTIR (dried sample) 1541 $cm^{-1}$ peak [for Ca-naphthenate] |
| 2. | DL-Malic Acid | Mono hydroxy di carboxylic acid (134) | 1:1 | 0.3752 | White ppt. 0.3441 gm | Absent |
| 3. | L(+) Tartaric Acid | Di hydroxy di carboxylic acid (150) | 1:1 | 0.4216 | White ppt. | Absent |

TABLE 4

| Unsaturated Di-Carboxylic Acid | | | | | | | | | |
|---|---|---|---|---|---|---|---|---|---|
| | | | | | Bottom Layer (Aqueous) | | | Top Layer (Organic) | |
| Exp. No. | Organic Acid | Type (Molecular wt.) | Mole Ratio (Acid:Ca) | Wt. of Acid (gm) 100% basis | Appearance | Conc. of Ca (by IC) [ppm] | Ca Removal Efficiency (%) | Conc. of Ca (by ICP) [ppm] | FTIR (dried sample) 1541 $cm^{-1}$ peak [for Ca-naphthenate |
| 1. | Maleic Anhydride | (98) | 1:1 | 0.2757 | No ppt. | 2208 | 97.95 | <1 | Absent |
| 2. | Maleic Acid | (116) | 1:1 | 0.3256 | No ppt. | 2213 | 97.95 | <1 | Absent |
| 3. | Fumaric Acid | (116) | 1:1 | 0.3256 | No ppt. | 2150 | 95.72 | 3 | Absent |

TABLE 5

| Saturated Mono Hydroxy poly-Carboxylic Acid | | | | | | |
|---|---|---|---|---|---|---|
| Exp. No. | Organic Acid | Type (Molecular wt.) | Mole Ratio (Acid:Ca) | Wt. of Acid (gm) 100% basis | Bottom Layer (Aqueous) Appearance | Top Layer (Organic) FTIR (dried sample) 1541 $cm^{-1}$ peak [for Ca-naphthenate] |
| 1. | Citric Acid | Mono hydroxy tri carboxylic acid (192) | 2:3 | 0.3595 | White ppt. 0.2578 gm | Absent |

TABLE 6

| Poly Carboxylic Acid | | | | | |
|---|---|---|---|---|---|
| Expt. No. | Organic Acid | Type (Molecular wt.) | Wt. of Acid (gm) 100% basis | Bottom Layer (Aqueous) Appearance | Top Layer (Organic) FTIR (dried sample) 1541 $cm^{-1}$ peak [for Ca-naphthenate] |
| 1. | Acumer-1000 | Acrylic Homo polymer (2000) | 0.2757 | White ppt. 0.217 g | Present |
| | | | 0.4008 | White ppt. 0.1864 g | Absent |
| | | | 0.8 | White ppt. 0.1307 g | Absent |
| | | | 1.14 | White ppt. 0.1224 g | Absent |
| | | | 1.7 | No ppt. | Absent |
| | | | 5.57 | No ppt. | Absent |
| 2. | Acumer-2000 | Carboxylic Sulfonated Copolymer (4500) | 0.1795 | white ppt. | Present |
| | | | 0.2757 | White ppt. 0.0839 g | Present |
| | | | 0.5111 | No ppt. | Absent |
| 3. | PM-200 | Polymaleic Acid (600) | 0.063 | Pale yellow ppt. 0.5607 g | 1726, 1681 & 1557 present |
| | | | 0.126 | Pale yellow ppt. 0.3237 g | 1682 & 1560 present |

TABLE 6-continued

| Poly Carboxylic Acid | | | | | |
|---|---|---|---|---|---|
| Expt. No. | Organic Acid | Type (Molecular wt.) | Wt. of Acid (gm) 100% basis | Bottom Layer (Aqueous) Appearance | Top Layer (Organic) FTIR (dried sample) 1541 $cm^{-1}$ peak [for Ca-naphthenate] |
| | | | 0.2772 | Pale yellow ppt. 0.614 g | 1532 present |
| | | | 0.3247 | Pale yellow ppt. 0.682 g | Absent |

II. Reaction Conditions: 50 gm Calcium-naphthenate in toluene having an amount of calcium of 2247 ppm in the hydrocarbon layer+50 gm DM water+Various Water Soluble Organic Acids (additive compounds) were refluxed at 98-105° C. temperature for 15 minutes.

TABLE 7

| Unsaturated Di-Carboxylic Acid | | | | | | | | |
|---|---|---|---|---|---|---|---|---|
| | | | | | Bottom Layer (Aqueous) | | Top Layer (Organic) | |
| Expt. No. | Organic Acid | Type (Molecular wt.) | Mole Ratio (Acid:Ca) | Wt. of Acid (gm) 100% basis | Appearance | Ca Removal Efficiency (%) | Conc. of Ca (by ICP) [ppm] | FTIR (dried sample) 1541 $cm^{-1}$ peak [for Ca-naphthenate] |
| 1. | Maleic Anhydride | (98) | 1:1 | 0.2757 | Very few white adherences on sidewall (2150 ppm Calcium) | 95.68 | <1 | Absent |

TABLE 8

| Saturated Mono Hydroxy poly-Carboxylic Acid | | | | | | |
|---|---|---|---|---|---|---|
| Exp. No. | Organic Acid | Type (Molecular wt.) | Mole Ratio (Acid:Ca) | Wt. of Acid (gm) 100% basis | Bottom Layer (Aqueous) Appearance | Top Layer (Organic) FTIR (dried sample) 1541 $cm^{-1}$ peak [for Ca-naphthenate] |
| 1. | Citric Acid | Mono hydroxy tri carboxylic acid (192) | 2:3 | 0.3595 | White ppt. 0.3148 gm | Absent |

In view of the above, it is clear that the present invention comprises the following items:

Item 1. Method of removal of calcium from hydrocarbon feedstock, comprising the steps of:

a) mixing hydrocarbon stream such as crude oil containing metals and salts thereof, such as calcium and calcium naphthenate, with an effective metal-removing-amount of an aqueous-extraction-solution of an additive comprising a chemical compound selected from a group consisting of maleic acid, maleic anhydride or fumaric acid or salts or derivatives thereof, or an appropriate combination thereof, enabling formation of a hydrocarboneous phase and an aqueous phase containing the metal ions;

b) permitting formation of two phases, such as said aqueous phase and said hydrocarboneous phase, wherein said aqueous phase includes ionic water-soluble metal-acid complex, of the calcium salt of said additives;

c) separating or permitting to separate by themselves said two phases in a crude desalter, or by using any of conventional processes of separation, such as countercurrent extraction;

d) removing the separated aqueous phase of step (c), containing said metal-acid complex;

e) processing the separated hydrocarboneous phase of step (c) by downstream hydrocarbon-processing techniques;

wherein, the contact time between said aqueous-extraction-solution and said hydrocarbon stream during the mixing action of step (a) is in the range from two seconds to six hours, preferably from five seconds to two hours;

wherein the temperature in said desalter is in the range from 93° C. to 163° C.; and wherein, the weight-percentage of the dosage of said chemical compound ranges from 0.001 to 5 of weight of said desalter-wash-water.

Item 2. Method of removal of calcium from hydrocarbon feedstock, as described in item 1, wherein the injection of said chemical compound to said desalter-wash-water, is continuous.

Item 3. Method of removal of calcium from hydrocarbon feedstock, as described in Item 1, wherein said mixing of step (a) of claim 1, is carried out vigorously for enabling said chemical compound to chelate the calcium.

Item 4. Method of removal of calcium from hydrocarbon feedstock, as described in item 1, wherein said chemical compound is used in molar, sub molar or excess-molar concentration with respect to the metals, in said hydrocarbon feedstock, such as said calcium or salt of calcium such as calcium naphthenate.

Item 5. Method of removal of calcium from hydrocarbon feedstock, as described in item 1, wherein said additives is used neat or in solution.

Item 6. Method of removal of calcium from hydrocarbon feedstock, as described in item 1, wherein said additive is added to said aqueous-extraction-solution of claim 1, prior to mixing thereof with said hydrocarbon stream.

While the above description contains many specificities, these should not be constructed as limitations in the scope of the invention, but rather as exemplification of each of the preferred embodiments thereof. Alterations to the preferred embodiments described above are possible without departing from the spirit of the invention. Accordingly, the scope of the invention should be determined not by the embodiments illustrated, but by the appended claims and their legal equivalents.

The invention claimed is:

1. A method of removal of calcium from a hydrocarbon feedstock consisting essentially of the steps of:

(a) mixing a hydrocarbon stream including crude oil containing metals and salts thereof, wherein the metals and salts thereof include calcium and/or calcium naphthenate, characterized in that the hydrocarbon stream is mixed with an effective metal removing amount of an aqueous extraction solution of an additive comprising a chemical compound selected from a group consisting of maleic acid, maleic anhydride, fumaric acid, salts of maleic acid, salts of maleic anhydride, salts of fumaric acid, derivatives of maleic acid, derivatives of maleic anhydride, derivatives of fumaric acid, and combinations thereof, enabling formation of a hydrocarboneous phase and an aqueous phase containing metal ions;

(b) permitting formation of said aqueous phase and said hydrocarboneous phase, wherein said aqueous phase includes an ionic water soluble metal acid complex of a calcium salt of said additive;

(c) separating or permitting to separate by themselves said two phases in a crude desalter, or by using any of conventional processes of separation;

(d) removing the separated aqueous phase of step (c), wherein the separated aqueous phase contains said metal acid complex; and (e) processing the separated hydrocarboneous phase of step (c) by downstream hydrocarbon processing techniques;

wherein, the contact time between said aqueous extraction solution of said additive and said hydrocarbon stream during the mixing action of step (a) is in the range from two seconds to six hours;

wherein the temperature in said crude desalter is in the range from 93° C. to 163° C.; and wherein the weight percentage of the dosage of said chemical compound ranges from 0.001 to 5 weight percent of desalter wash water.

2. The method of claim 1, wherein the injection of said chemical compound to said desalter wash water is continuous.

3. The method of claim 1, wherein said mixing of step (a) is carried out vigorously for enabling said chemical compound to chelate the calcium.

4. The method of claim 1, wherein said chemical compound is used in a concentration selected from molar, sub molar and excess molar concentration with respect to the metals in said hydrocarbon feedstock, including said calcium salt of calcium, including calcium naphthenate.

5. The method of claim 1, wherein said additive is added to said aqueous extraction solution prior to mixing thereof with said hydrocarbon stream.

6. The method of claim 1, wherein said conventional processes of separation comprise countercurrent extraction.

7. The method of claim 1, wherein said contact time between said aqueous extraction solution and said hydrocarbon stream during the mixing action of said step (a) is in the range from five seconds to two hours.

8. A method of calcium from a hydrocarbon feedstock as claimed in claim 1, wherein the method comprising steps of:

(a) mixing a hydrocarbon stream including crude oil containing metals and salts thereof, wherein the metals and salts thereof include calcium and/or calcium naphthenate, characterized in that the hydrocarbon stream is mixed with an effective metal removing amount of an aqueous extraction solution of an additive comprising a chemical compound selected from a group consisting of maleic acid, maleic anhydride, fumaric acid, salts of maleic acid, salts of maleic anhydride, salts of fumaric acid, derivatives of maleic acid, derivatives of maleic anhydride, derivatives of fumaric acid, and combinations thereof, enabling formation of a hydrocarboneous phase and an aqueous phase containing metal ions;

(b) permitting formation of said aqueous phase and said hydrocarboneous phase, wherein said aqueous phase includes an ionic water soluble metal acid complex of a calcium salt of said additive;

(c) separating or permitting to separate by themselves said two phases in a crude desalter, or by using any of conventional processes of separation;

(d) removing the separated aqueous phase of step (c), wherein the separated aqueous phase contains said metal acid complex; and (e) processing the separated hydrocarboneous phase of step (c) by downstream hydrocarbon processing techniques;

wherein, the contact time between said aqueous extraction solution of said additive and said hydrocarbon stream during the mixing action of step (a) is in the range from two seconds to six hours;

wherein the temperature in said crude desalter is in the range from 93° C. to 163° C.; and wherein the hydrocarbon stream is mixed with said aqueous extraction solution of said additive at a pH of not more than 2; and wherein the hydrocarbon stream is mixed with said aqueous extraction solution of said additive without addition of a base.

9. The method of claim 8, wherein said no precipitates are formed on reaction of said chemical compound and metal and salts thereof.

10. The method of claim 8, wherein no fouling is caused on reaction of said chemical compound and metal and salts thereof.

11. A method of removal of calcium from a hydrocarbon feedstock comprising the steps of:

(a) mixing a hydrocarbon stream including crude oil containing metals and salts thereof, wherein the metals and salts thereof include calcium and/or calcium naphthenate, characterized in that the hydrocarbon stream is mixed with an effective metal removing amount of an aqueous extraction solution of an additive comprising a chemical compound selected from a group consisting of maleic acid, maleic anhydride, fumaric acid, salts of maleic acid, salts of maleic anhydride, salts of fumaric acid, derivatives of maleic acid, derivatives of maleic anhydride, derivatives of fumaric acid, and combinations thereof, enabling formation of a hydrocarboneous phase and an aqueous phase containing metal ions;

(b) permitting formation of said aqueous phase and said hydrocarboneous phase, wherein said aqueous phase includes an ionic water soluble metal acid complex of a calcium salt of said additive;

(c) separating or permitting to separate by themselves said two phases in a crude desalter;

(d) removing the separated aqueous phase of step (c), wherein the separated aqueous phase contains said metal acid complex; and (e) processing the separated hydrocarboneous phase of step (c) by downstream hydrocarbon processing techniques;

wherein, the contact time between said aqueous extraction solution of said additive and said hydrocarbon stream during the mixing action of step (a) is in the range from two seconds to six hours;

wherein the temperature in said crude desalter is in the range from 93° C. to 163° C.; and wherein the hydrocarbon stream is mixed with said aqueous extraction solution of said additive at a pH of not more than 2; and wherein the hydrocarbon stream is mixed with said aqueous extraction solution of said additive without addition of a base.

12. A method of removal of calcium from a hydrocarbon feedstock, wherein the method comprises steps of:

(a) mixing a hydrocarbon stream including crude oil containing metals and salts thereof, wherein the metals and salts thereof include calcium and/or calcium naphthenate, characterized in that the hydrocarbon stream is mixed with an effective metal removing amount of an aqueous extraction solution of an additive comprising a chemical compound selected from a group consisting of maleic anhydride, fumaric acid, salts of maleic anhydride, salts of fumaric acid derivatives of maleic anhydride, derivatives of fumaric acid, and combinations thereof, enabling formation of a hydrocarboneous phase and an aqueous phase containing metal ions;

(b) permitting formation of said aqueous phase and said hydrocarboneous phase, wherein said aqueous phase includes an ionic water soluble metal acid complex of a calcium salt of said additive;

(c) separating or permitting to separate by themselves said two phases in a crude desalter, or by using any of conventional processes of separation;

(d) removing the separated aqueous phase of step (c), wherein the separated aqueous phase contains said metal acid complex; and (e) processing the separated hydrocarboneous phase of step (c) by downstream hydrocarbon processing techniques;

wherein, the contact time between said aqueous extraction solution of said additive and said hydrocarbon stream during the mixing action of step (a) is in the range from two seconds to six hours;

wherein the temperature in said crude desalter is in the range from 93° C. to 163° C.; and wherein the hydrocarbon stream is mixed with said aqueous extraction solution of said additive at a pH of not more than 2; and wherein the hydrocarbon stream is mixed with said aqueous extraction solution of said additive without addition of a base.

* * * * *

UNITED STATES PATENT AND TRADEMARK OFFICE

CERTIFICATE OF CORRECTION

PATENT NO. : 8,685,233 B2
APPLICATION NO. : 12/376962
DATED : April 1, 2014
INVENTOR(S) : Mahesh Subramaniyam It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 900 days.

Signed and Sealed this
Twenty-ninth Day of September, 2015

Michelle K. Lee

Michelle K. Lee
*Director of the United States Patent and Trademark Office*